US009800008B2

(12) United States Patent
Morris et al.

(10) Patent No.: US 9,800,008 B2
(45) Date of Patent: Oct. 24, 2017

(54) TERMINAL CRIMPING MACHINE HAVING A WIRE CLAMP

(71) Applicant: Tyco Electronics Corporation, Berwyn, PA (US)

(72) Inventors: Michael Morris, Harrisburg, PA (US); Neil Edward Deming, Lewisberry, PA (US); Christopher John Karrasch, Boiling Springs, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 440 days.

(21) Appl. No.: 14/310,421

(22) Filed: Jun. 20, 2014

(65) Prior Publication Data

US 2015/0372437 A1 Dec. 24, 2015

(51) Int. Cl.

*H01R 43/048* (2006.01)
*H01R 43/052* (2006.01)
*B30B 15/00* (2006.01)

(52) U.S. Cl.

CPC ..... *H01R 43/048* (2013.01); *B30B 15/0094* (2013.01); *H01R 43/052* (2013.01); *H01R 43/0486* (2013.01); *H01R 43/0488* (2013.01); *Y10T 29/49187* (2015.01); *Y10T 29/53065* (2015.01); *Y10T 29/53235* (2015.01)

(58) Field of Classification Search

CPC H01R 43/048; H01R 43/0488; H01R 43/052; H01R 43/0486; B30B 15/0094; Y10T 29/49187; Y10T 29/53065; Y10T 29/53235

See application file for complete search history.

(56) References Cited

U.S. PATENT DOCUMENTS 2,908,910 A * 10/1959 Andren ..... H01R 43/052 29/33 E
3,641,650 A * 2/1972 Folk ..... H01R 43/04 29/736
3,685,148 A * 8/1972 Garfinkel ..... H01R 43/0482 174/84 C
3,713,196 A * 1/1973 Garner ..... H01R 43/027 29/564.1
4,450,619 A * 5/1984 Wright ..... H05K 13/0452 140/105

(Continued)

FOREIGN PATENT DOCUMENTS

EP 0 667 658 A2 8/1995
EP 2 174 390 A1 4/2010
WO 2008 / 087938 A1 7/2008

OTHER PUBLICATIONS

International Search Report, International Application PCT/US2015/035469, International Filing Date Jun. 12, 2015.

*Primary Examiner* — Carl Arbes

(57) ABSTRACT

A terminal crimping machine includes a termination tool having crimp tooling defining a crimping zone that receives the terminal and the wire. The crimp tooling is actuated during a crimp stroke to crimp the terminal to the wire. The terminal crimping machine includes a wire clamp holding the wire near the crimping zone. The wire clamp releases the wire prior to completion of the crimp to allow extrusion of the wire during the crimping process. Optionally, the wire clamp may release the wire prior to bottom dead center of the crimp stroke. The wire clamp may release the wire after the terminal partially retains the wire.

15 Claims, 3 Drawing Sheets

(56) References Cited

U.S. PATENT DOCUMENTS

| | | | | | |
|---|---|---|---|---|---|
| 4,828,516 | A * | 5/1989 | Shaffer | ..... | H01R 43/058 29/863 |
| 4,890,384 | A * | 1/1990 | Shaffer | ..... | H01R 43/058 29/863 |
| 4,976,132 | A * | 12/1990 | Shaffer | ..... | H01R 43/058 29/753 |
| 7,168,159 | B2 * | 1/2007 | Imai | ..... | H01R 43/048 29/281.4 |
| 2010/0269332 | A1 * | 10/2010 | Wasilko | ..... | H01R 43/052 29/753 |
| 2012/0314226 | A1 * | 12/2012 | Kelly | ..... | H01R 43/0428 356/625 |

* cited by examiner

TERMINAL CRIMPING MACHINE HAVING A WIRE CLAMP

BACKGROUND OF THE INVENTION

The subject matter herein relates generally to terminal crimping machines for crimping electrical terminals to a wire.

Terminal crimping machines have long been used in the connector industry to effect high-speed mass termination of various cables. It is common practice for the terminal crimping machine to have an interchangeable tooling assembly called an applicator. In general, such terminal crimping machines are referred to as a terminator or press, however other types of terminal crimping machines may similarly be used, such as a lead maker, a bench machine, or a hand crimping tool. The terminal crimping machines include crimp tooling, such as an anvil and a movable ram that is moved relative to the anvil during a crimping stroke to crimp a terminal or connector to an end of a wire. The wire is typically held by a wire clamp during the crimping operation.

However, these known terminal crimping machines are not without disadvantages. For instance, during crimping a phenomenon known as extrusion of the wire may occur when the terminal is compressed around the wire. Such extrusion is problematic when using aluminum wires as a high force is need to crimp the terminal to the aluminum wire. When extrusion occurs, the wire is lengthened longitudinally. Such lengthening causes the wire to bend or kink as the wire is fixed in the terminal and at the wire clamp. The bending or kinking can damage the wire, such as by severing one or more strands of the wire. The wire needs to be reworked, such as by manually straightening the wire after the crimping process is complete.

A need remains for a terminal crimping machine that does not damage the wire during the crimping process.

BRIEF DESCRIPTION OF THE INVENTION

In one embodiment, a terminal crimping machine is provided that crimps a terminal to a wire. The terminal crimping machine includes a termination tool having crimp tooling defining a crimping zone that receives the terminal and the wire. The crimp tooling is actuated during a crimp stroke to crimp the terminal to the wire. The terminal crimping machine includes a wire clamp holding the wire near the crimping zone. The wire clamp releases the wire prior to completion of the crimp to allow extrusion of the wire during the crimping process. Optionally, the wire clamp may release the wire prior to bottom dead center of the crimp stroke. The wire clamp may release the wire after the terminal partially retains the wire.

Optionally, the crimp tooling may include an anvil and a ram movable in an advancing direction and a retracting direction relative to the anvil during the crimp stroke. The wire clamp may release the wire as the ram is moving in the advancing direction prior to the ram changing direction and moving in the retracting direction.

Optionally, the wire clamp may include an upper clamp and a lower clamp. The upper clamp may be movable between a clamped position and an unclamped position. The upper clamp may be released from the clamped position based on the position of the crimp tooling.

Optionally, the terminal crimping machine may include a sensor determining a position of the crimped tooling. The wire clamp may be released based on an output of the sensor. Optionally, the wire clamp may be pneumatically controlled.

Optionally, the crimp tooling may transition during a crimp forming stage of the crimp stroke between an initial contact position and a bottom dead center position. The crimp tooling may change the shape of the terminal around the wire during the crimp forming stage. The wire clamp may release the wire during the crimp forming stage. Optionally, the wire clamp may release the wire prior to the bottom dead center position. The wire may extrude longitudinally during an extrusion stage of the crimp forming stage. The wire clamp may release the wire prior to the extrusion stage.

In another embodiment, a terminal crimping machine is provided that crimps a terminal to a wire. The terminal crimping machine includes a termination tool having an actuator and crimp tooling comprising an anvil and a ram movable by the actuator. A crimping zone is defined between the ram and the anvil that receives the terminal and the wire. The ram is actuated by the actuator during a crimp stroke in an advancing direction and then in a retracting direction. The ram is actuated by the actuator in the advancing direction from a released position to an initial contact position where the ram makes initial contact with the terminal. The ram is actuated by the actuator in the advancing direction from the initial contact position to a bottom dead center position where the ram is at the closest position to the anvil during the crimp stroke. The ram is actuated by the actuator in the retracting direction from the bottom dead center position to a separation position where the ram separates from the terminal. The ram is actuated by the actuator in the retracting direction from the separation position to the released position where the ram is at the furthest position from the anvil during the crimp stroke. A wire clamp holds the wire near the crimping zone. The wire clamp releases the wire as the ram is moved in the advancing direction prior to the ram reaching the bottom dead center position.

In a further embodiment, a method of crimping a terminal to a wire is provided that includes positioning a terminal in a crimping zone between an anvil and a movable ram, loading a wire through a wire clamp to the crimping zone, the end of the wire being received in the terminal, clamping the wire with the wire clamp to hold the position of the wire relative to the terminal, actuating the ram through a crimp stroke from a released position in an advancing direction to a bottom dead center position and then in a retracting direction back to the released position, and releasing the wire clamp as the ram is moved in the advancing direction prior to the ram being advanced to the bottom dead center position.

DETAILED DESCRIPTION OF THE INVENTION

Figure 1:
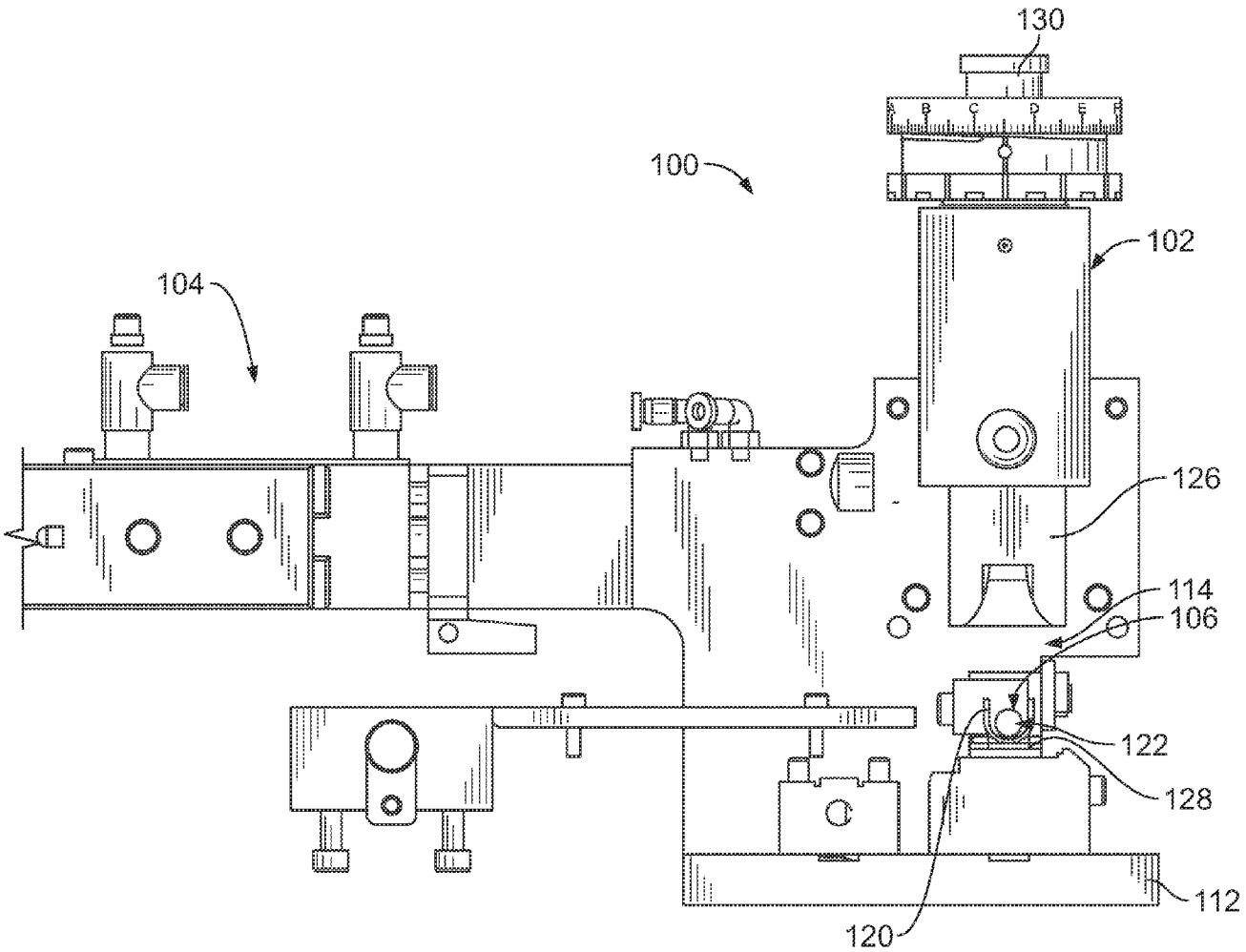
FIG. 1 is a front view of a terminal crimping machine having a termination tool used for crimping terminals to wires.
Figure 2:
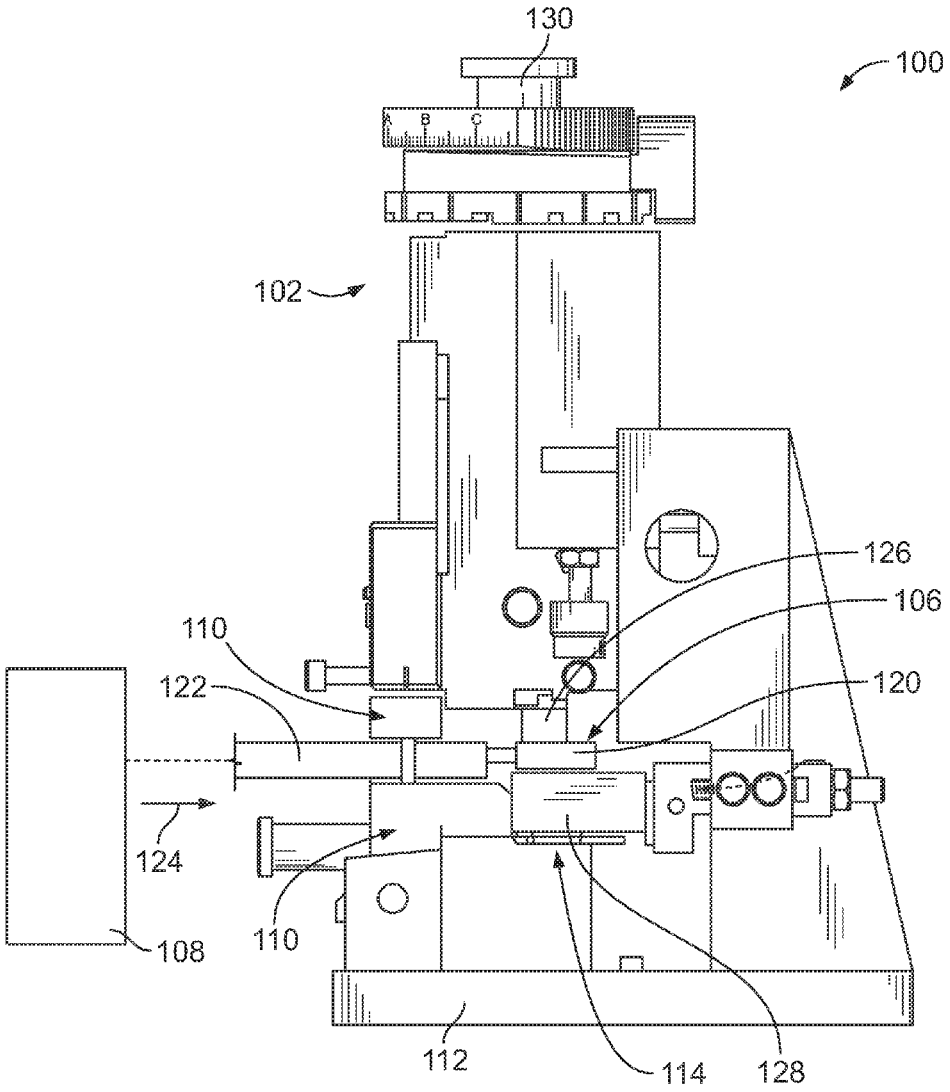
FIG. 2 is a side view of the terminal crimping machine.

FIG. 1 is a front view of a terminal crimping machine 100 having a termination tool 102 used for crimping connectors or terminals to wires, however, other types of terminal crimping machines 100 may be used. FIG. 2 is a side view of the terminal crimping machine 100. In the illustrated embodiment, the terminal crimping machine 100 is a terminator or press, however other types of terminal crimping machines may similarly be used, such as a lead maker, a bench machine, a hand crimping tool and the like. Furthermore, while the termination tool 102 is illustrated and described hereinafter with respect to an applicator (may be referred to hereinafter as applicator 102), other types of termination tools 102 may be used depending on the type of terminal crimping machine.

A terminal feeder 104 (FIG. 1) is used to feed terminals 120 to a crimping zone 106. In the illustrated embodiment, the terminal feeder 104 is an electrically actuated feeder, however other types of feeders, such as pneumatic feeders, cam and linkage feeders, and the like, may be used depending on the type of terminal crimping machine.

A wire feeder 108 (FIG. 2) is used to feed a wire 122 to the crimping zone 106. A wire clamp 110 (FIG. 2) holds the wire 122 in position in the crimping zone 106 during the crimping process. The wire clamp 110 is positioned near the crimping zone 106 and holds the wire 122 near the crimping zone 106. In the illustrated embodiment, the wire clamp 110 is a pneumatic clamp, however other types of clamps, such as electrically actuated clamps, mechanical clamps such as cam and linkage clamps, and the like, may be used depending on the type of terminal crimping machine.

The applicator 102 is coupled to a frame 112 of the terminal crimping machine 100. Crimp tooling 114 is coupled to the applicator 102 for crimping the electrical connectors or terminals 120 to an end of the corresponding wire 122 in the crimping zone 106. The applicator 102 may be removed and replaced with a different applicator, such as when a different size/type of terminal 120 is to be terminated, when a different size/type of wire 122 is to be terminated, when the applicator 102 is worn or damaged, or when an applicator having a different configuration is desired. As such, multiple applicators 102 may be used with each terminal crimping machine 100, and the different applicators 102 may have different set-up configurations.

The wire clamp 110 is coupled to the frame 112. The wires 122 are delivered in a wire loading direction 124 through the wire clamp 110 to the crimping zone 106. In an exemplary embodiment, the wires 122 are aluminum wires, however other types of wires may be used, such as copper wires.

In an exemplary embodiment, the crimp tooling 114 includes a ram 126 and a stationary anvil 128. During operation, the ram 126 is actuated or driven through a crimp stroke by a driving mechanism or actuator 130 of the terminal crimping machine 100. The ram 126 is movable in an advancing direction and a retracting direction relative to the anvil 128 during the crimp stroke. Optionally, the actuator 130 may be a motor having a crank shaft that moves the ram 126. Alternatively, the actuator 130 may be a linear actuator, a piezoelectric actuator, a pneumatic actuator, and the like.

Figure 3:
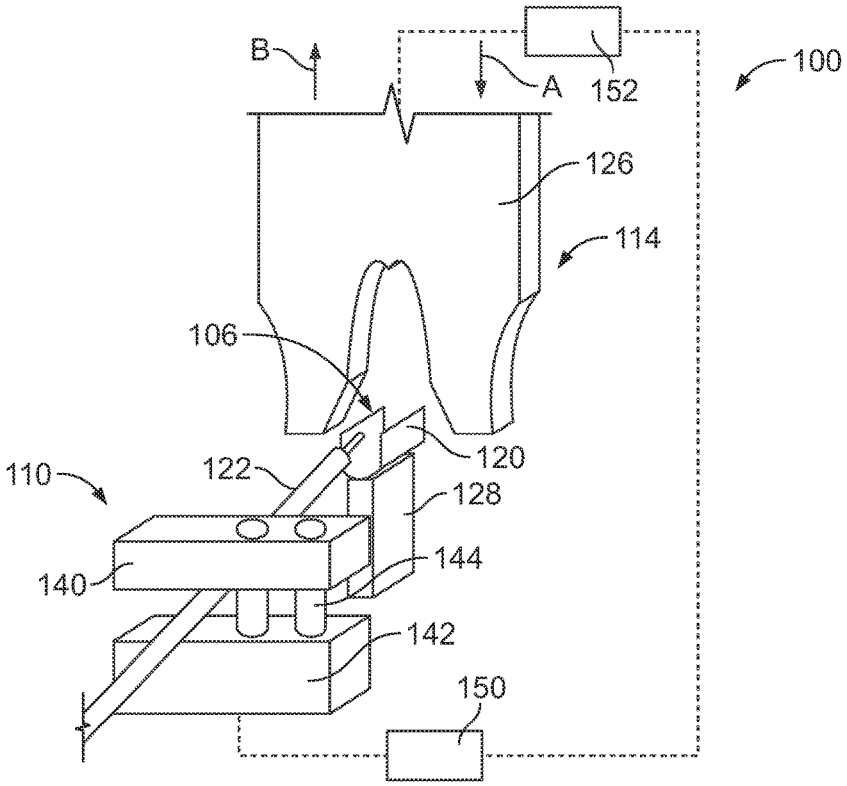
FIG. 3 illustrates a portion of the terminal crimping machine showing crimp tooling in a released position and a wire clamp in an unclamped position.
Figure 4:
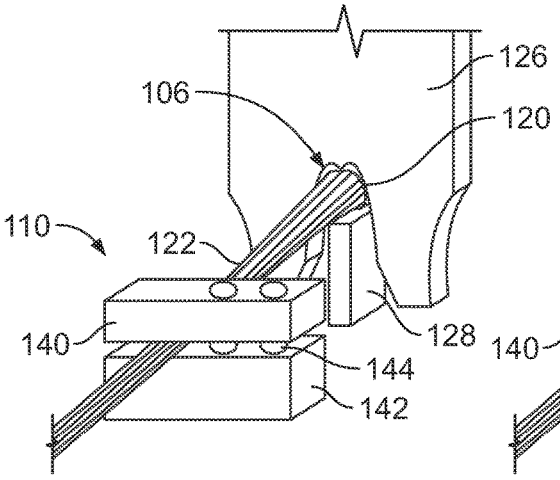
FIG. 4 illustrates a portion of the terminal crimping machine showing the crimp tooling in a crimping position and the wire clamp in a clamped position.
Figure 5:
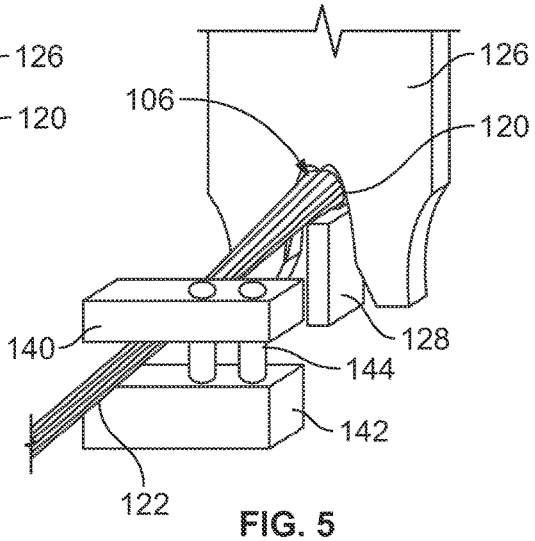
FIG. 5 illustrates a portion of the terminal crimping machine showing the crimp tooling in a crimping position and the wire clamp in an unclamped position.

FIG. 3 illustrates a portion of the terminal crimping machine 100 showing the crimp tooling 114 in a released position and the wire clamp 110 in an unclamped position. FIG. 4 illustrates a portion of the terminal crimping machine 100 showing the crimp tooling 114 in a crimping position and the wire clamp 110 in a clamped position. FIG. 5 illustrates a portion of the terminal crimping machine 100 showing the crimp tooling 114 in a crimping position and the wire clamp 110 in an unclamped position.

The ram 126 is cyclically driven through the crimp stroke from a released position at a top of the crimp stroke to the crimping position, such as through a bottom dead center position at a bottom of the crimp stroke, then returning to the released position. The crimp stroke has both an advancing or downward component, shown by the arrow A, and a return or upward component, shown by the arrow B.

During operation, the ram 126 is advanced downward toward the anvil 128 to an initial contact position, in which the ram 126 initially contacts the terminal 120. The ram 126 continues downward in the advancing direction to the bottom dead center position. As the ram 126 is advanced from the initial contact position to the bottom dead center position, the ram 126 transitions through a crimp forming stage of the crimp stroke. The terminal 120 is formed around the wire 122 (the wire 122 is shown in FIG. 3 with a jacket and is shown in FIGS. 4 and 5 without the jacket showing a plurality of wire strands) during the crimp forming stage. The crimp tooling 114 changes the shape of the terminal 120 around the wire 122 during the crimp forming stage. The crimping of the terminal 120 to the wire 122 occurs during the downward component of the crimp stroke. The ram 126 then returns upward to the released position at the top of the crimp stroke. At some point during the releasing stage of the crimp stroke, the ram 126 separates from the terminal 120, referred to as the separation position of the ram 126. Due to the elastic nature of the metal material of the terminal 120 and the wire 122, the terminal 120 and the wire 122 have some slight spring back after the ram 126 releases from the bottom dead center position. In the released position, the ram 126 is positioned away from the anvil 128 and from the terminal 120.

The wire clamp 110 includes an upper clamp 140 and a lower clamp 142. Optionally, the upper clamp 140 may be movable with respect to the lower clamp 142, which may be stationary. A return spring 144 may be provided to hold the upper clamp 140 in a normally open position. The spring force may be overcome to close the upper clamp 140 during operation of the wire clamp 110. The wire clamp 110 is movable between an unclamped position (open) and a clamped position (closed). The wire 122 is movable relative to the wire clamp 110 in the unclamped position. The wire clamp 110 holds the wire 122 in the clamped position. The upper clamp 140 may be electronically controlled, pneumatically controlled, mechanically controlled, and the like. In an exemplary embodiment, the upper clamp 140 is released from the clamped position based on the position of the crimp tooling 114. For example a sensor may be provided to provide an indication of when to release the upper clamp 140. In other embodiments, the upper clamp 140 may be automatically released during the crimp stroke, such as when the crimp tooling 114 is at a predetermined position. For example, a mechanical linkage may be provided between the ram and the wire clamp 110 to release the upper clamp 140.

During the crimp forming stage, the terminal 120 compresses against the wire 122. The wire 122 may be extruded due to the compressive forces, which causes the wire to lengthen in a longitudinal direction. The extrusion stage of the crimp forming stage occurs as the ram 126 approaches the bottom dead center position. For example, the extrusion stage may occur in the bottom 20% of the crimp forming stage. The wire clamp 110 is located and configured to coordinate with the wire feed and the crimp stroke to avoid damage to the wire 122 caused by lengthening of the wire 122, such as bending or kinking of the wire 122. The wire 122 is fed into the crimping zone 106 and held by the wire clamp 110. The wire clamp 110 releases the wire 122 prior to completion of the crimp to allow extrusion of the wire 122 during the crimping process. The wire clamp 110 releases the wire 122 as the ram 126 is moving in the advancing direction prior to the ram 126 changing direction and moving in the retracting direction. In other words, the wire clamp 110 releases to the unclamped position prior to the ram 126 reaching the bottom dead center position. Optionally, the wire clamp 110 may release to the unclamped position prior to the extrusion stage of the crimp forming stage. When the wire clamp 110 releases, the wire 122 is free to move away from the crimping zone 106, such as to accommodate for the lengthening of the wire 122 during crimping. In an exemplary embodiment, the wire clamp 110 releases after the terminal 120 is crimped enough that the terminal 120 at least partially retains the wire 122. For example, during initial forming of the terminal 120, the walls of the terminal 120 may be pressed against the wire 122 forming an interference between the terminal 120 and the wire 122 that provides enough force to hold the longitudinal position of the wire 122 relative to the terminal 120, thus ensuring that the wire 122 does not fall out of the terminal 120 during the remainder of the crimp forming process. Once held with sufficient force, the wire clamp 110 serves no purpose for holding the wire 122, and thus may be released. Such release is able to occur prior to the extrusion stage, which allows the wire 122 to move without being damaged by the wire clamp 110.

In an exemplary embodiment, the wire clamp 110 is operatively coupled to a controller 150 (FIG. 3) that controls the state of the wire clamp 110. For example, the controller 150 controls the clamping and unclamping of the wire clamp 110. The controller 150 may be coupled to an actuator that actuates the wire clamp 110. For example, the actuator may be a pneumatic actuator, an electronic actuator, and the like. Optionally, the controller 150 may be coupled to the actuator 130 that controls the operation of the ram 126. The control of the wire clamp 110 may be tied to the control of the actuator 130. For example, the clamping and the unclamping of the wire clamp 110 may occur at predetermined times of the crimp stroke.

In an exemplary embodiment, the controller 150 is coupled to a sensor 152 (FIG. 3). The sensor 152 may provide an output to the controller 150 based on the operation of the terminal crimping machine 100 indicative of a time to release the wire clamp 110. For example, the sensor 152 may be a position sensor used to sense a position of the crimp tooling 114, such as the ram 126. When the ram 126 is at a predetermined position, the position sensor 152 indicates such position to the controller 150 signaling time to release the wire clamp 110. Other types of sensors may be used in alternative embodiments. For example, a force sensor may be used to determine the force on the terminal 120 and/or wire 122. Extrusion may occur beyond a predetermined force and the force sensor may indicate time to release the wire clamp 110 prior to reaching such force threshold. A force indicative of sufficient wire capture may be measurable such that the force sensor may indicate time to release the wire clamp 110 after reaching such force threshold. The sensor 152 may be a time sensor. The crimp stroke may occur in a predetermined amount of time and the controller 150 may release the wire clamp 110 at a predetermined time interval after the start of the crimp stroke. The sensor 152 may be a visual sensor, such as a camera, that triggers a signal based on images of the terminal 120 and/or wire 122.

A method of crimping the terminal 120 to the wire 122 is provided using the terminal crimping machine 100. The method includes positioning the terminal 120 in the crimping zone 106 between the anvil 128 and the movable ram 126. The method includes loading or feeding the wire 122 through the wire clamp 110 to the crimping zone 106. In the crimping zone, the end of the wire 122 is received in the terminal 120 for crimping. The method includes clamping the wire 122 with the wire clamp 110 to hold the position of the wire 110 relative to the terminal 120, at least until the wire 120 is held by the partially formed terminal 120. The method includes actuating the ram 126 through a crimp stroke from a released position in an advancing direction to a bottom dead center position. The method includes actuating the ram 126 in a retracting direction back to the released position. The method includes releasing the wire clamp 110 as the ram 126 is moved in the advancing direction prior to the ram 126 being advanced to the bottom dead center position. The releasing of the wire clamp 110 is performed prior to damaging extrusion of the wire 122, such as in the longitudinal direction, during crimping of the terminal 120 to the wire 122. Optionally, the releasing of the wire clamp 110 may be based on a position of the ram 126, which may be sensed by a sensor.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A terminal crimping machine that crimps a terminal to a wire, the terminal crimping machine comprising:

a frame;

crimp tooling fixed to the frame, the crimp tooling comprising an anvil and a ram defining a crimping zone therebetween that receives the terminal and the wire, the crimp tooling being actuated during a crimp stroke to crimp the terminal to the wire;

a wire clamp fixed to the frame proximate to the crimp tooling, the wire clamp clamping the wire to hold the wire relative to the terminal near the crimping zone during at least part of the crimp stroke, the wire clamp releasing the wire prior to completion of the crimp to allow extrusion of the wire during the crimping process.

2. The terminal crimping machine of claim 1, wherein the wire clamp releases the wire prior to a bottom dead center of the crimp stroke.

3. The terminal crimping machine of claim 1, wherein the wire clamp releases the wire after the terminal partially retains the wire.

4. The terminal crimping machine of claim 1, wherein the ram is movable in an advancing direction and a retracting direction relative to the anvil during the crimp stroke, the wire clamp releasing the wire as the ram is moving in the advancing direction prior to the ram changing direction and moving in the retracting direction.

5. The terminal crimping machine of claim 1, wherein the wire clamp comprises an upper clamp and a lower clamp, the upper clamp being movable between a clamped position and an unclamped position, the upper clamp being released from the clamped position based on the position of the crimp tooling.

6. The terminal crimping machine of claim 1, further comprising a sensor determining a position of the crimped tooling, the wire clamp being released based on an output of the sensor.

7. The terminal crimping machine of claim 1, wherein the wire clamp is pneumatically controlled.

8. The terminal crimping machine of claim 1, wherein the crimp tooling transitions during a crimp forming stage of the crimp stroke between an initial contact position and a bottom dead center position, the crimp tooling changing the shape of the terminal around the wire during the crimp forming stage, the wire clamp releasing the wire during the crimp forming stage.

9. The terminal crimping machine of claim 8, wherein the wire clamp releases the wire prior to the bottom dead center position.

10. The terminal crimping machine of claim 8, wherein the wire extrudes longitudinally during an extrusion stage of the crimp forming stage, the wire clamp releasing the wire prior to the extrusion stage.

11. A terminal crimping machine that crimps a terminal to a wire, the terminal crimping machine comprising:

a frame;

a termination tool fixed to the frame, the termination tool having an actuator and crimp tooling comprising an anvil and a ram movable by the actuator, a crimping zone being defined between the ram and the anvil that receives the terminal and the wire, the ram being actuated by the actuator during a crimp stroke in an advancing direction and then in a retracting direction, the ram being actuated by the actuator in the advancing direction from a released position to an initial contact position where the ram makes initial contact with the terminal, the ram being actuated by the actuator in the advancing direction from the initial contact position to a bottom dead center position where the ram is at the closest position to the anvil during the crimp stroke, the ram being actuated by the actuator in the retracting direction from the bottom dead center position to a separation position where the ram separates from the terminal, the ram being actuated by the actuator in the retracting direction from the separation position to the released position where the ram is at the furthest position from the anvil during the crimp stroke; and a wire clamp fixed to the frame proximate to the termination tool, the wire clamp clamping the wire to hold the wire near the crimping zone, the wire clamp releasing the wire as the ram is moved in the advancing direction prior to the ram reaching the bottom dead center position.

12. The terminal crimping machine of claim 11, wherein the ram changes a shape of the terminal around the wire during a crimp forming stage of the crimp stroke as the ram transitions from the initial contact position to the bottom dead center position, the wire clamp releasing the wire during the crimp forming stage.

13. The terminal crimping machine of claim 12, wherein the wire extrudes longitudinally during an extrusion stage of the crimp forming stage, the wire clamp releasing the wire prior to the extrusion stage.

14. The terminal crimping machine of claim 11, wherein the wire clamp comprises an upper clamp and a lower clamp, the upper clamp being movable between a clamped position and an unclamped position, the upper clamp being released from the clamped position based on the position of the ram.

15. The terminal crimping machine of claim 11, further comprising a sensor determining a position of the ram, the wire clamp being released based on an output of the sensor.

* * * * *